United States Patent [19]

Hancy

[11] Patent Number: 4,557,620

[45] Date of Patent: Dec. 10, 1985

[54] POUNCE PAD

[76] Inventor: Raymond E. Hancy, P.O. Box 70412, Eugene, Oreg. 97401

[21] Appl. No.: 685,891

[22] Filed: Dec. 24, 1984

[51] Int. Cl.[4] ..... A45D 33/02; B41L 27/26

[52] U.S. Cl. ..... 401/200; 401/184; 101/125

[58] Field of Search ..... 401/200, 184; 427/282, 427/197; 101/114, 125; 223/20

[56] References Cited

U.S. PATENT DOCUMENTS

| | | | |
|---|---|---|---|
| 1,318,256 | 10/1919 | Birsan | 401/184 |
| 1,576,666 | 3/1926 | Mason | 101/125 |
| 1,617,278 | 2/1927 | Spurrier | 101/125 |
| 1,626,323 | 4/1927 | Bendick | 101/125 |
| 1,784,912 | 12/1930 | Scott | 427/197 X |
| 2,137,125 | 11/1938 | Ballon | 401/200 X |
| 2,204,605 | 6/1940 | Landsman | 401/200 |
| 2,317,662 | 4/1943 | Zimmerman | 401/200 |
| 2,919,642 | 1/1960 | Mooney | 101/125 |
| 3,729,011 | 4/1973 | Gleicher | 401/200 X |
| 4,319,852 | 3/1982 | Bell et al. | 401/185 |

FOREIGN PATENT DOCUMENTS

| | | | |
|---|---|---|---|
| 2000973 | 9/1969 | France | 401/184 |

*Primary Examiner*—Clifford D. Crowder
*Attorney, Agent, or Firm*—John F. Ingman

[57] ABSTRACT

A pounce applicator which embodies a hand-sized storage container, a portion of which also serves as the gripping surface, and a replaceable pad unit which includes a core containing a reservoir for pounce and a system of pounce carrying channels, a support screen, a pounce flow limiter, a foam pad and a covering cloth. Included is external access to permit refilling of the reservoir. Enhanced distribution of pounce, particularly for vertical and overhead surfaces, is obtained through the use of an externally pressed bellows-shaped plug which provides increased air pressure internal to the pad unit.

2 Claims, 4 Drawing Figures

POUNCE PAD

BACKGROUND OF THE INVENTION

1. Field of the Invention

The present invention generally relates to devices for the application of pounce to a perforated pattern so as to transfer a design to an underlying surface, and more particularly, is concerned with a contained pounce pad, with enclosed internal pounce storage and an external refilling capability, which permits a clean method of evenly distributing pounce when used, and provides mess-free storage when not in actual use.

2. Description of the Prior Art

The art of sign painting has long relied upon the application of pounce, a fine powder such as pulverized charcoal, chalk, cornstarch or talcum, to a perforated pattern so as to transfer a design to an underlying surface. The design, so tranferred to a surface, facilitates the painting thereof.

Sign painters have historically used a pounce bag, that is, a rag on which pounce is placed at the center and then gathered and bound with twine or tape. The pounce is applied by means of tapping the bag on the pattern, followed by a rubbing motion wherein the pounce penetrates the perforations in the pattern and thereby transmits the design to the underlying surface. It is believed that Michelangelo used the pounce bag in conjunction with the painting of the ceiling of the Sistine Chapel. However, the use of a pounce bag is a messy operation, as the application of pounce is not well controlled, the user's hands get covered with the pounce, and pounce is applied to some extent both downwind and wherever the bag is set down. Furthermore there is a storage problem, the painter having, at a minimum, two pounce bags, one with a dark pounce such as charcoal or blue chalk for light surfaces, and another with a light-colored pounce for dark surfaces.

There exists a definite need for a pounce applicator which is self-contained and self-storing, which contains an internal source of pounce which can be easily replaced as it is used by a simple and clean external loading procedure, and which distributes, upon use, an even distribution of pounce to the desired pattern or surface. Such pounce applicator should be inexpensive and durable.

SUMMARY OF THE INVENTION

The present invention provides a pounce applicator which is designed to satisfy the aforementioned needs. The invention embodies a contained pounce pad having multi-stage pounce flow control and a closed internal source of pounce with external access for replacement of pounce.

Accordingly, the present invention provides a pounce pad which is comprised of a convenient, hand-sized storage container, a portion of which also serves as the gripping surface for the pad, and a replaceable pop-out pad unit which includes a core containing a reservoir for pounce and a system of pounce distribution channels, a support screen, a pounce flow limiter, a foam pad, and a covering cloth, all assembled to provide optimum flow and distribution of pounce. The invention also embodies external access to the centralized pounce reservoir to provide a rapid and clean method of refilling the reservoir with pounce as needed. Furthermore, the invention provides a means for enhanced distribution of pounce utilizing externally applied force on an alternative version of the filler plug so as to increase internal air pressure and thus aid in the emission of pounce, such emission having particular usefulness to the application of pounce on vertical and overhead surfaces.

DESCRIPTION OF THE PREFERRED EMBODIMENT

Figure 1:
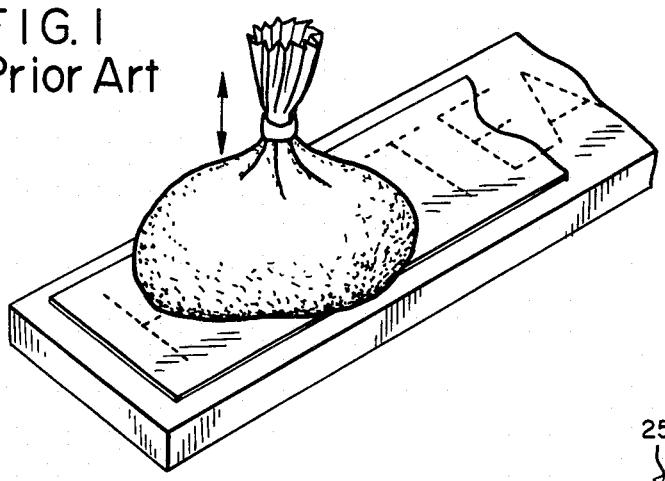
FIG. 1 Prior Art
FIG. 1 is an illustration of prior art, as reflected in a pounce bag.

Referring now to the drawings, and more particularly to FIG. 1, there is shown a home-made pounce bag, which is representative of prior art. The manner of construction and usage of such pounce bags has been previously described.

Figure 2:
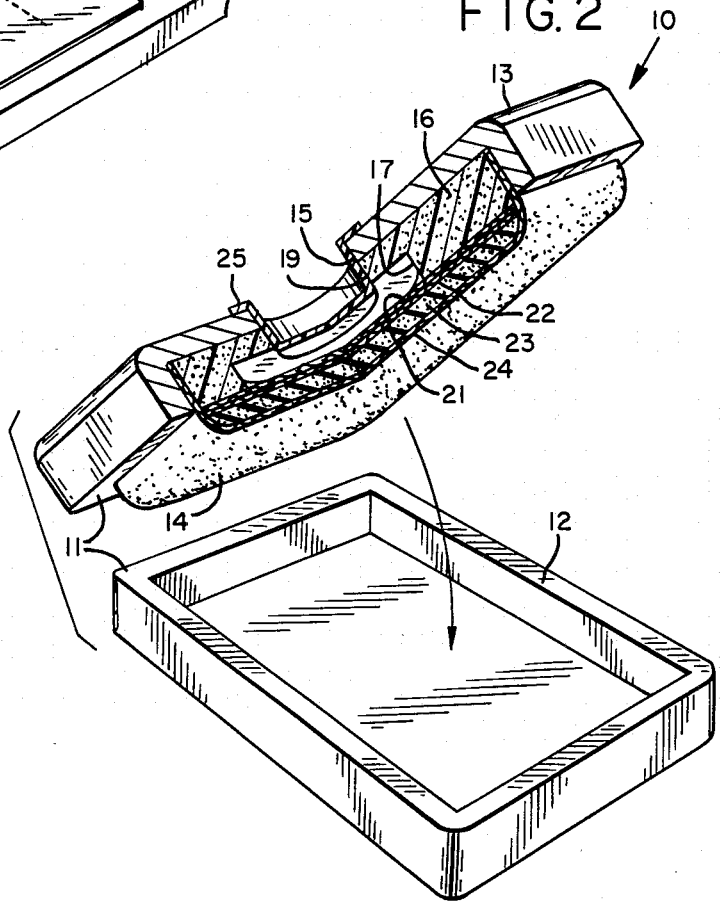
FIG. 2 shows a partially sectioned view of the present invention, illustrating the container top, with replaceable pad unit, separated from the container bottom.
Figure 3:
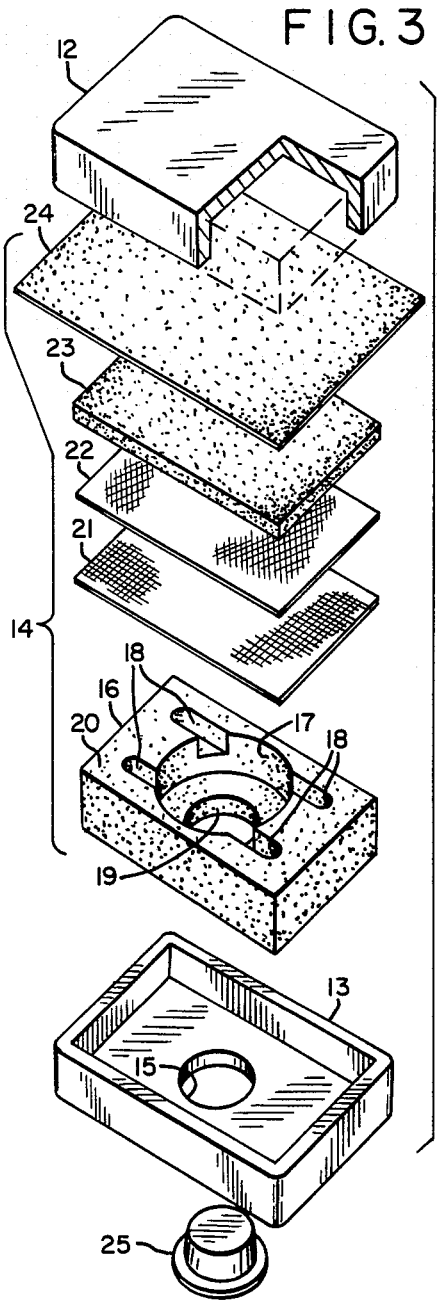
FIG. 3 provides an exploded view of the invention shown in FIG. 2.

FIG. 2 and FIG. 3 provide views of the a preferred embodiment of the pounce pad 10. The container 11 is a hard shell, of a size to be held conveniently in the hand during use. While a rectangular box shape is the preferred embodiment, other equally effective shapes are possible. The container 11, is divided into two parts, the container bottom 12 and the container top 13. The container bottom 12 serves as a protective cover for the working surface of the pad unit 14 during storage. The container top 13 holds the pad unit 14 securely by a pressure fit. Thus, the container top 13 and the pad unit 14 are removed together from the container bottom 12 when the pounce pad 10 is being used. The container top 13 is grasped in the hand of the user so that the cloth covering 24 comes in contact with the pattern to achieve the desired release and distribution of pounce. The actual application technique used will be art to the individual user, the present invention having been designed so as to permit variations in technique depending on the requirement and the desires of the user. The container top 13 has a section of material removed from its surface, thereby forming a refilling hole 15 so as to permit access for the replenishment of pounce. In the preferred embodiment, the refilling hole 15 is circular in shape and approximately $1\frac{1}{8}$ inch in diameter, other shapes and sizes of access being within the scope of the invention.

Contained within the pad unit 14 is a core 16 of lightweight material, in which a reservoir 17 and multiple distribution channels 18 have been molded or created by other means, such reservoir 17 and distribution channels 18 retaining their general shape during use. The material selected for the core 16 in the preferred embodiment is a beaded styrofoam because of its light weight, lack of permeation by the pounce, retention of shape, ease of shaping, ready availability, and low cost. Other materials having generally similar characteristics could also be used for the core 16. As illustrated, a reservoir 17, in right cylindrical shape, has been established near the center of core 16 for the purpose of providing an enclosed chamber to supply an internal source of pounce during application. In the preferred embodiment, the reservoir 17 is approximately two inches in diameter and $\frac{5}{8}$ inch deep. Continuing from the bottom of the reservoir 17, on through the core 16, is an access channel 19 to the reservoir 17 which corresponds to in diameter and fits adjacent to the refilling hole 15 in the container top 13. Thus, when core 16 and container top 13 are fit together, external access for the purpose of directly refilling the reservoir 17 with pounce has been provided.

In addition, on core 16, distribution channels 18 have been provided which connect directly with the reservoir 17 and which extend outward therefrom, parallel with the long axis of the core 16. These distribution channels 18 provide unimpeded distribution of the pounce directly from the reservoir 17 to parts of the pad unit 14 which are more distant from the center, and thus create a more even distribution of pounce over the surface of the pad. use. They also provide additional internal pounce storage. In the preferred embodiment, four channels, each of $\frac{1}{2}$ inch diameter and extending approximately $\frac{3}{4}$ inch are used. Other combinations of channels also could be used, depending on the distribution of pounce desired.

Located next to the face 20 of core 16, which is formed as described above with the reservoir 17 and distribution channels 18 located open on face 20, is a layer of open mesh, rigid, screening material 21. This screening material 21 provides a support surface for the reservoir 17 and the distribution channels 18 which readily permits the passage of pounce. The screening material 21 used in the preferred embodiment is buckrum webbing, a commonly available open mesh, sized cotton fabric of approximately 30 threads per inch.

Adjacent to the screening material 21 is located flow limiting material 22 which serves to restrict the free passage of the pounce by providing a relatively tight mesh which limits the quentity of pounce that can pass. As indicated above, the application of pounce by the painter is an art and the application technique used is dictated by the requirements of the job and the personal preferences of the painter. Various flows of pounce are possible, ranging from heavy to light. In the preferred embodiment, a flow limiting material 22 which provides a medium flow, as being of greatest general use, is utilized, such material being a single layer of Gull Glass 100% cotton toweling having a mesh of approximately 60 threads per inch. The use of other suitable flow limiting materials to provide a heavier, equivalent or lighter flow of pounce, as desired, are within the scope of this invention.

The foam pad 23 is placed adjacent to the flow limiting material 22 and serves as a spreading conduit for the even distribution of the pounce to the covering cloth 24. The pounce permeates the foam pad 23 and also achieves a lateral distribution therein, due to air exchange in the body of the foam pad 23 through constant flexing of the foam material while in use. When the foam pad 23, though the action of the user, is compressed, the pounce is dispersed therefrom in an essentially even distribution to the working surface. In addition to its distributive properties, the foam pad 23 provides a cushion effect to prevent tearing of the fragile perforated pattern paper. In the preferred embodiment, a polyurethane, low density, flexible pad of approximately $\frac{1}{4}$ inch thickness is used.

The cloth covering 24 protects the foam pad 23, and also serves to even the distribution of pounce. The cloth covering 24 in the preferred embodiment is a brush type cloth having a high coarse nap, such as is generally found in a terry-cloth fabric. Such a cloth covering provides a brush-like movement to the pounce during rubbing which aids the pounce in passing through the perforations on the pattern to impart the desired density of design on the underlying surface. The screening material 21, flow limiting material 22, and foam pad 23 are held to the core 16 by attaching, by glue or otherwise, the covering cloth 24 to the sides of core 16. A stretch terry-cloth fabric is helpful but not necessary.

Thus, the core 16, screening material 21, flow limiting material 22, foam pad 23 and covering cloth 24 are combined together to form a pad unit 14, which acts as a replaceable pop-out insert, allowing the container 11 to be reused with replaceable pad units 14.

Returning to the container bottom 13 and core 16, it was noted that an access channel 19 had been established for the external refilling of the reservoir 17. In order to keep the pounce from leaving the way it entered, that is, by means of access channel 19, a filler plug 25 is tightly inserted into the filler opening. The filler plug 25, made of low density flexible polyethylene or other suitable material, penetrates the container bottom 13 through opening 15 and into core 16, thereby sealing the filler opening. The filler plug 25 may be translucent, so that the painter can determine the type and color of pounce in the reservoir 17 without opening the container 11. The filler plug 25, of course, is removed to permit refilling of the reservoir 17, and then subsequently replaced.

Figure 4:
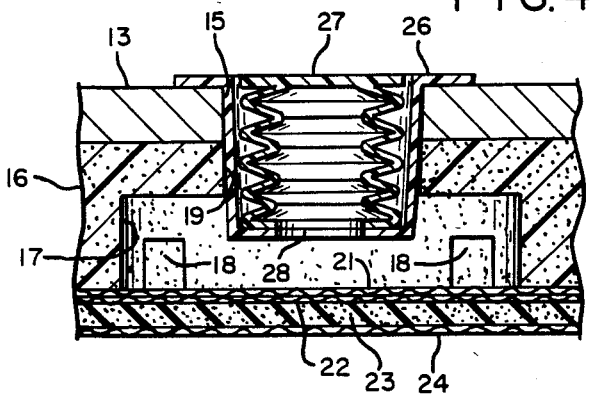
FIG. 4 presents a sectional view of an alternative, pressure generating external plug.

An alternative to the simple filler plug 25 may be used to enhance the distribution of pounce. FIG. 4 shows an alternative air-enhancing filler plug 26, having the same characteristics as filler plug 25 with the exception that a portion is shaped in bellows fashion, so that, when force or pressure is applied to the end 27 of the alternative air-enhancing plug 26, the protruding portion collapses and compresses the air therein. The compressed air passes through the air-jet hole 28 and into the reservoir 17 and distribution channels 18, creating increased air pressure to the device, and thereby enhancing the movement of pounce through the flow control and out from the covering cloth 24. Such air-enhanced distribution of pounce may serve to change the traditional method of application by eliminating some or all of the conventional tapping technique, the air-jet serving to regulate the flow of pounce to the pad working surface. The air-enhanced distribution will be especially useful in the application of pounce to vertical or overhead surfaces, where the natural effect of gravity is not of assistance. Still further, the air-pressure provided will serve to prevent clogging and caking of the pounce and keep open the pathways to the working surface of the pounce pad.

It can be seen from the foregoing description that the present invention provides a device which allows the painter to apply pounce to perforated patterns in an efficent and clean manner, to refill his pounce pad applicator pounce reservoir easily without messily diassembling the applicator, and to store his pounce applicator in its own integral container without concern of inadvertant distribution of pounce to the surroundings. In addition, with the air-enhancing filler plug 26, the painter will have a vastly improved method of application of pounce to vertical and overhead surfaces. The development of this unique industrial tool is expected to revolutionize the manner of application of pounce in the transfer of designs to other surfaces.

It is thought that the pounce pad of the present invention and its many attendant advantages will be understood from the foregoing description and that it will be apparent that various changes may be made in form, construction and arrangement of the parts thereof without departing from the spirit and scope of the invention or sacrificing all of its material advantages, the form hereinbefore described being merely an exemplary embodiment thereof.

I claim:

1. A device for the application of pounce to a perforated pattern so as to transfer a design to an underlying surface, comprising:

(a) a replaceable pad unit which is comprised of:

(2) a lightweight, nonpermeable core wherein are located a cavity approximate to the center of said core and extending into the core from a face thereof, and having an open surface on said face, said cavity forming a pounce storage reservoir, and multiple open surface pounce distribution channels which are connected to and extend from the open surface of said pounce storage reservoir, said distribution channels providing both additional pounce storage volume and an unobstructed pathway for the distribution of pounce toward more distant portions of the face of said core;

said core also including an opening formed in said core from the bottom center of the said internal storage reservoir and continuing through the said core to the opposing surface thereof, said opening forming a portion of a pounce loading access channel in combination with an adjacently located and corresponding opening formed in the containing vessel, so that by introducing pounce through said opening formed in the containing vessel and hence through the said opening formed in the core, the pounce will enter said internal storage reservoir;

(2) open mesh, rigid, screening material, located adjacent to the face of the core wherein the open surfaces of the said pounce storage reservoir and the said pounce distribution channels are located, said screening material serving as a support surface for the said pounce storage reservoir and distribution channels;

(3) pounce-flow limiting material, located adjacent to said screening material, said flow limiting material serving to restrict the passage of pounce and to limit the amount of pounce available for subsequent permeation;

(4) a foam pad, located adjacent to the said flow limiting material, said foam pad, being permeable to pounce, serving to evenly distribute, through its compressible surface, that pounce which penetrates the said flow limiting material; and (5) a cloth covering of brush-type cloth which distributes, in conjunction with a rubbing motion, that pounce which has been emitted from said foam pad, so that the pounce is applied to the perforated pattern in such a manner as to create a useful image on the underlying surface;

wherein the said cloth covering encompasses the said foam pad, flow limiting material, screening material, and core face, and is securely attached to the sides of the core so as to create a replaceable pad unit;

(b) a hollow vessel of hand-grasping size, which is divisible into two (2) parts, wherein one part, as a cover, is removable and serves to protect the contents when not in use, and the second part holds the contents by a secure fit and also acts as a handle during use when grasped in the hand of the user;

said second part also having an opening formed in its outer surface for the purpose of establishing, in conjunction with the said adjacent and corresponding opening formed in said core, the said external pounce loading access channel; and (c) a plug which tightly fits and penetrates the opening formed in said containment vessel and the said corresponding opening formed in the said core, thereby sealing the pounce access channel, such plug being readily removable and reinsertable when the device requires reloading with pounce.

2. The pounce application device, as recited in claim 1, wherein the plug, in addition, has a bellows-designed protruding portion, wherein, as a result of external pressure manually applied by the user, said protruding portion collapses in bellows fashion, the air contained therein being compressed and thereby forced through the said pounce loading access channel into the said pounce storage reservoir and multiple distribution channels, where the increased air pressure enhances the flow of pounce from the said pad unit.

* * * * *